US006588026B2

(12) United States Patent
Meier et al.

(10) Patent No.: US 6,588,026 B2
(45) Date of Patent: Jul. 8, 2003

(54) METHOD OF, AND APPARATUS FOR, INTRODUCING A CLEANING AGENT AND/OR DISINFECTANT INTO SANITARY FACILITIES

(75) Inventors: Hans-Peter Meier, Regensberg (CH); Hans-Jörg Studer, Hittnau (CH)

(73) Assignee: HTS International Trading AG, Baar (CH)

( * ) Notice: Subject to any disclaimer, the term of this patent is extended or adjusted under 35 U.S.C. 154(b) by 0 days.

(21) Appl. No.: 09/989,978

(22) Filed: Nov. 21, 2001

(65) Prior Publication Data

US 2002/0069457 A1 Jun. 13, 2002

Related U.S. Application Data

(63) Continuation of application No. PCT/CH00/00277, filed on May 18, 2000.

(30) Foreign Application Priority Data

May 27, 1999 (EP) ..... 99810462

(51) Int. Cl.[7] ..... E03D 9/02
(52) U.S. Cl. ..... 4/226.1; 4/224
(58) Field of Search ..... 4/226.1, 224; 222/57, 222/63, 642, 643

(56) References Cited

U.S. PATENT DOCUMENTS 1,753,662 A * 4/1930 Merker
1,991,235 A * 2/1935 True et al.
2,397,677 A * 4/1946 MacGlashan
3,200,840 A * 8/1965 Watts
3,224,637 A * 12/1965 Muller
3,455,321 A * 7/1969 Flynn
3,830,403 A * 8/1974 Castan et al. ..... 222/57
3,882,882 A * 5/1975 Preisig ..... 222/57
3,976,220 A * 8/1976 de Kanter ..... 222/57
4,183,105 A 1/1980 Womack
5,143,257 A * 9/1992 Austin et al. ..... 222/57
5,513,394 A * 5/1996 Kodaira ..... 4/226.1

FOREIGN PATENT DOCUMENTS

| | | | |
|---|---|---|---|
| DE | 19 15 100.9 | | 12/1970 |
| EP | 0 338 825 A1 | | 10/1989 |
| EP | 0 579 581 A1 | | 1/1994 |
| FR | 81 02061 | | 7/1982 |
| GB | 521368 | * | 5/1940 |
| WO | WO 89/00220 | | 1/1989 |

* cited by examiner

*Primary Examiner*—Robert M. Fetsuga
*Assistant Examiner*—Khoa O Huynh
(74) *Attorney, Agent, or Firm*—Schweitzer Cornman Gross & Bondell LLP

(57) ABSTRACT

A method for introducing liquid agents, such as cleansers or disinfectant, into the water supply of a sanitary facility, such as a water closet includes the monitoring of the pressure characteristics of a flush cycle and determining an appropriate time during the cycle for introduction of the liquid agent. A subsequent flush cycle is similarly monitored. At the determined time the agent is added. Preferably, the determined time is towards the end of the flush cycle. An apparatus for carrying out the method includes a liquid reception, a pressure sensor located in a line connecting the reservoir to the water supply line for the sanitary facility, and a control unit which operates either a pump or a valve. The liquid can be introduced into the water supply either by the pump or by suction.

12 Claims, 4 Drawing Sheets

METHOD OF, AND APPARATUS FOR, INTRODUCING A CLEANING AGENT AND/OR DISINFECTANT INTO SANITARY FACILITIES

This application is a Continuation of PCT/CH00/00277, filed May 18, 2000.

The present invention relates to a method and apparatus for introducing liquid agents, such as cleansers and disinfectants, into sanitary facilities, such as water closets.

BACKGROUND OF THE INVENTION

In addition to disinfectant blocks positioned in the flushing-water inflow of water closets (wc), units which add a cleaning and/or disinfecting liquid to the flushing water either at a certain point in time or continuously are also known.

A unit which can be suspended in a toilet is known, inter alia, from WO 93/03232. The unit sprays an oily liquid into the toilet by way of a straightforward hose pump and is actuated when someone sits on the seat surface (toilet seat). This type of pretreatment is intended to reduce dirt deposits.

The self-cleaning toilet of U.S. Pat. No. 4,183,105 has, in the flushing cistern, a separate container with a cleaning agent which, distributed via the pressure of the water line and spray nozzles cleans the walls of the toilet bowl.

A disadvantage with known devices is that both the point in time at which the liquid is introduced and the quantity of the liquid can only be adapted to a very limited extent to prevailing conditions. The resulting effect may consequently be insufficient. Further consumption of the cleaning agent may be high, as a result of which, if used widely, these units are extremely harmful to the environment.

An improved apparatus is described in EP-A1-579 581. By means of an electronically controlled hose pump, a defined quantity of disinfecting liquid is pumped from a storage container and mixed with incoming flushing water in a mixing chamber. The pumping operation is initiated by a switch which is actuated via a rubber diaphragm which closes off the mixing chamber when the chamber fills with water. The electronic control means assigned to the pump limits the running time of the latter, with the result that the disinfectant is metered within certain limits. During the next flushing operation, the fixture located in the mixing chamber flows into the incoming flushing water; a residual amount, due to the pressure conditions in the pipelines, wets the latter even at the end of the flushing operation, which increases the level of hygiene in the installation.

A disadvantage with such an apparatus is that the hose pump has to operate against the internal pressure of the already water-filled mixing chamber, and that a relatively large quantity of disinfectant is necessary in order to achieve an appropriate effect, at all, since the mixture, which flows in throughout the flushing operation is initially highly diluted.

BRIEF DESCRIPTION OF THE DRAWING

An object of the present invention is to eliminate the disadvantages of the prior art and to provide an efficient means of controlling and feeding a liquid agent, dependent on the specific requirements of the installation, which results in a minimal, negligible level of harm to the environment, requires minimum maintenance and supplies the liquid agent such that it is provided in the urinal or the toilet before soiling or odors take hold. The liquid is intended to be distributed uniformly and to reach all parts of the facility which may be soiled during normal use.

The foregoing and other objects are met by the method of the present invention which comprises the mixing of the liquid agent with incoming flushing water at a reduced pressure. The pressure of the flushing water is monitored, and the liquid agent is metered into the water at a final time interval during the flushing process. The surfaces wetted by the liquid agent/flushing water mixture are thus completely wetted while the liquid agent is at a low level of dilution, added to the flushing water in a mixing section upstream of the installation.

Figure 1:
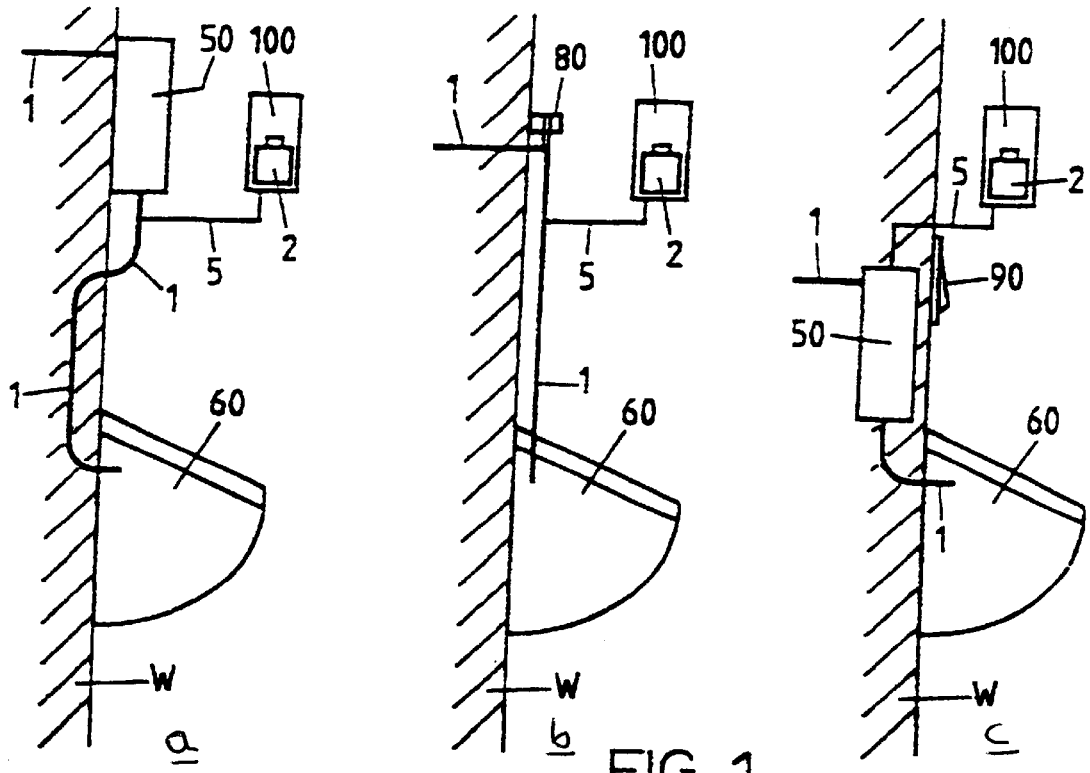

By monitoring the pressure of the incoming flushing water and the significant drop in pressure which occurs at the end of each flushing operation, the supply of liquid agents can be optimized, with correct timing, while potential harmful effects produced by the agents are minimized.

The present invention makes use of the finding that each non-stationary operation of a sanitary facility has its own characteristics which, in the case of reproducible operations, can also generate reproducible signals which can be used in a particular fashion.

With such recognition, it is possible to determine the ideal point in time for adding a liquid such that it is still distributed in the installation, but is not unnecessarily diluted and/or flushed away by water flowing in after it. The effects of oily emulsions in particular are thus maintained until the installation is next used and prevents, or at least reduces, subsequent soiling of installation to a quite considerable extent.

The method according to the invention is thus very efficient, cost-effective and environmentally friendly. The liquid agent itself may be composed of a wide variety of different, tried and tested active agents which are known per se, and may also include easily degradable wetting agents which adhere particularly well to smooth ceramic surfaces. Even in the case of frequent use in large-scale public toilet facilities, significant amounts of active-ingredient-containing liquid in the downstream sewage system cannot be detected.

Adding the liquid agent to the flushing water at a positive pressure ensures good mixing of the liquid with the flushing water, even with the flushing water pressure decreasing. Providing the liquid agent by suction generated by the flushing water itself is particularly cost-effective and largely maintenance-free.

Monitoring the usage of the facility and controlling the addition of the liquid agent accordingly can help to reduce the usage of the liquid, can increase the maintenance intervals (for replacement of the liquid containers), and can reduce further any harmful effects.

An apparatus in accordance with the invention comprises a storage tank for the liquid agent and a pump for metering the liquid agent into a branch line from the water supply to the sanitary facility. A pressure sensor monitors the branch line and determines flush duration, which is used to time the metering of the liquid in the subsequent flush cycle.

An apparatus of the present invention incorporating a mixing section is particularly favorable for installation in existing facilities, since such a mixing section can easily be integrated in the flushing line, and adapted as a type of intermediate element.

The apparatus of the invention is advantageous in comparison to systems which employ a fixed determination of the drop in pressure, particularly when pressure fluctuations or effects of the building (structure-borne sound, etc.) are to be expected. In addition, it is thus possible for the metering quantity of the liquid to be empirically coordinated with the local requirements.

Arranging the pressure sensor in an intermediate container has proven successful and results in reproducible and easily further processible signal profiles.

A very effective and easy-to-realize way of mixing the liquid in the flushing water is achieved by an ejector. Forming the ejector as a coaxial line to a float or supply line does not require commercially available flushing cisterns to be changed in any way and is thus suitable and easy to implement, in particular for new installations.

A suction-based embodiment is favorable in terms of flow and energy and is additionally very cost-effective to produce and to maintain, since it does not require in any auxiliary energy.

BRIEF DESCRIPTION OF THE DRAWINGS

Figure 2:
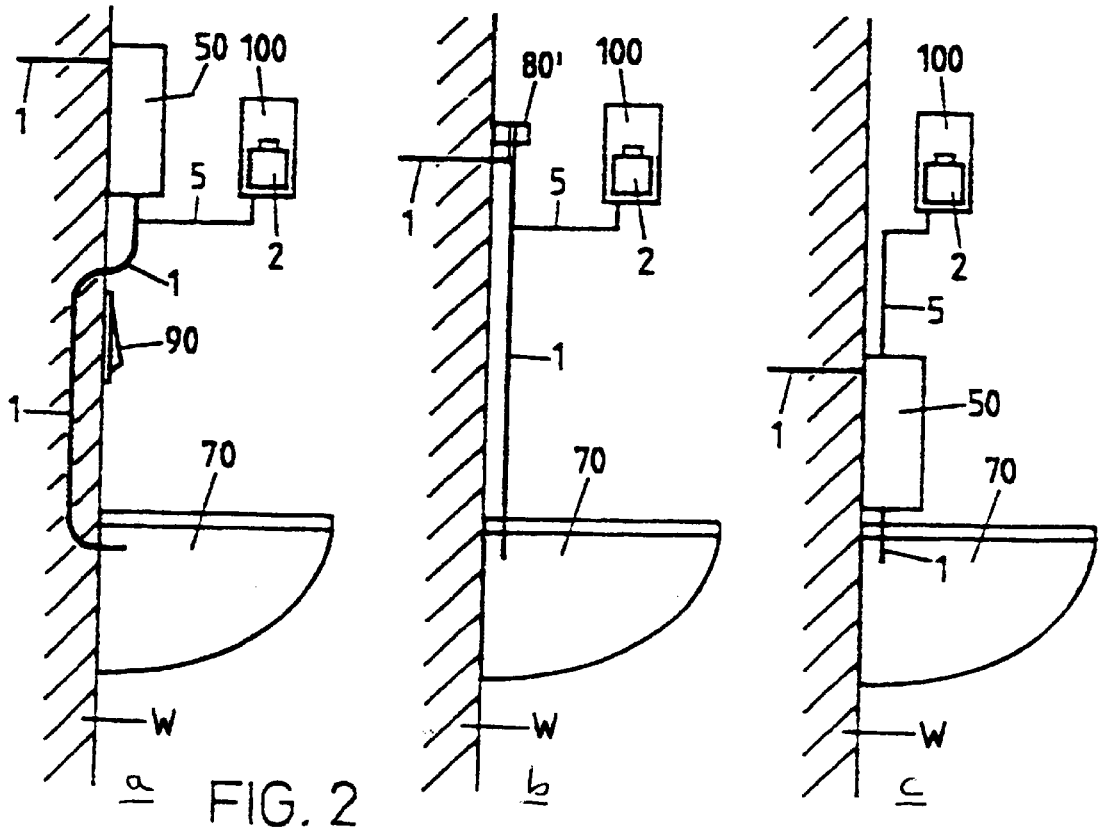
Figure 3:
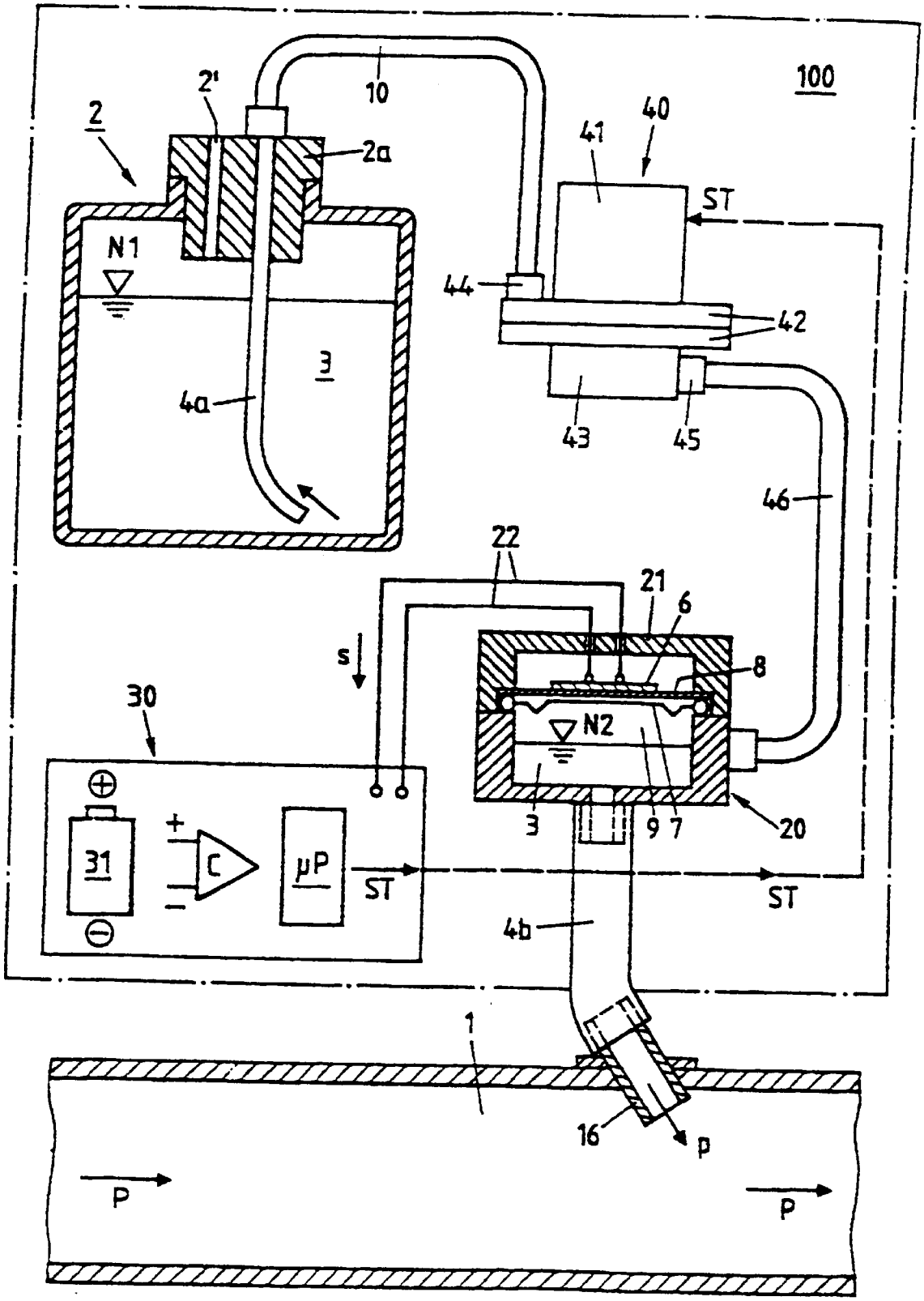
Figure 4:
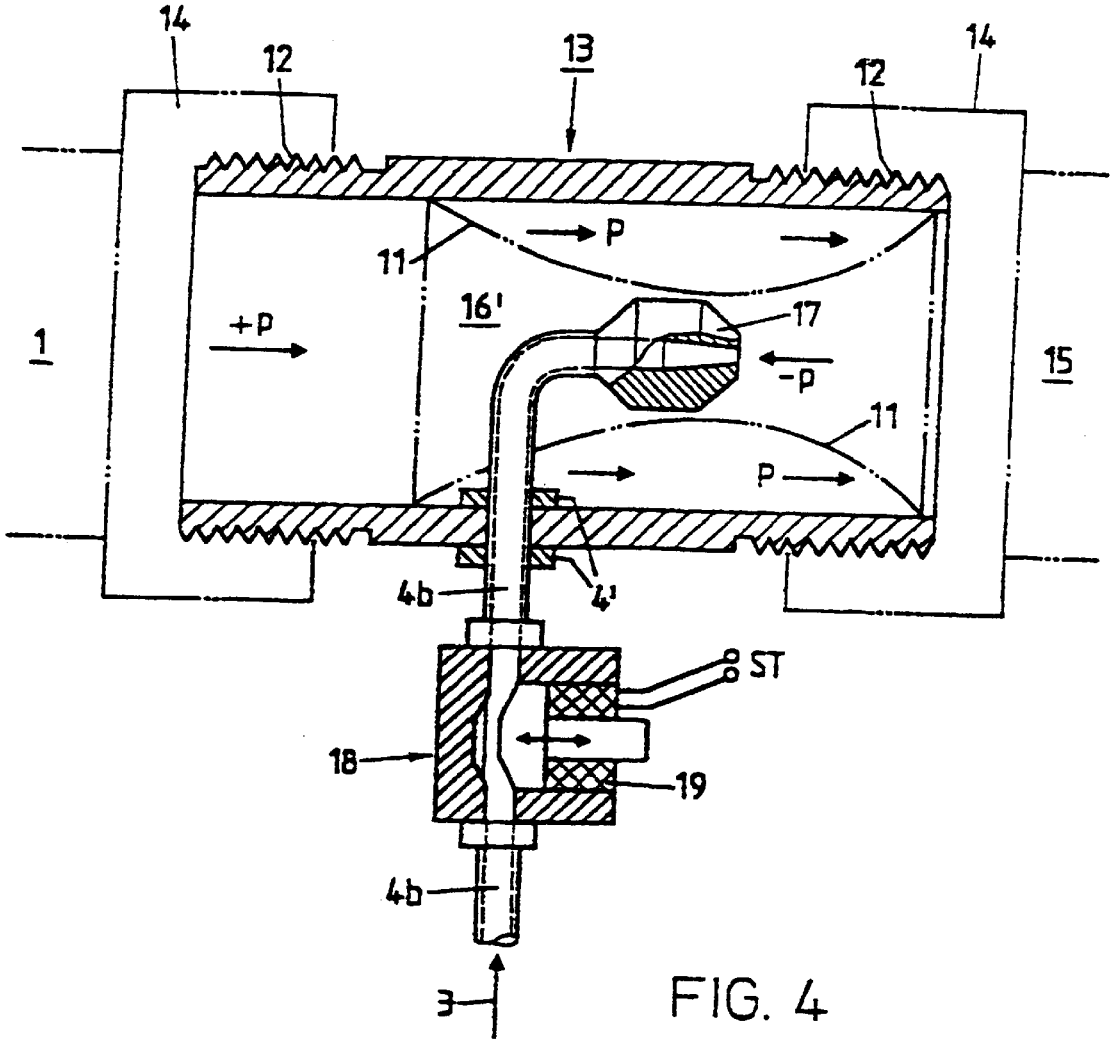
Figure 5:
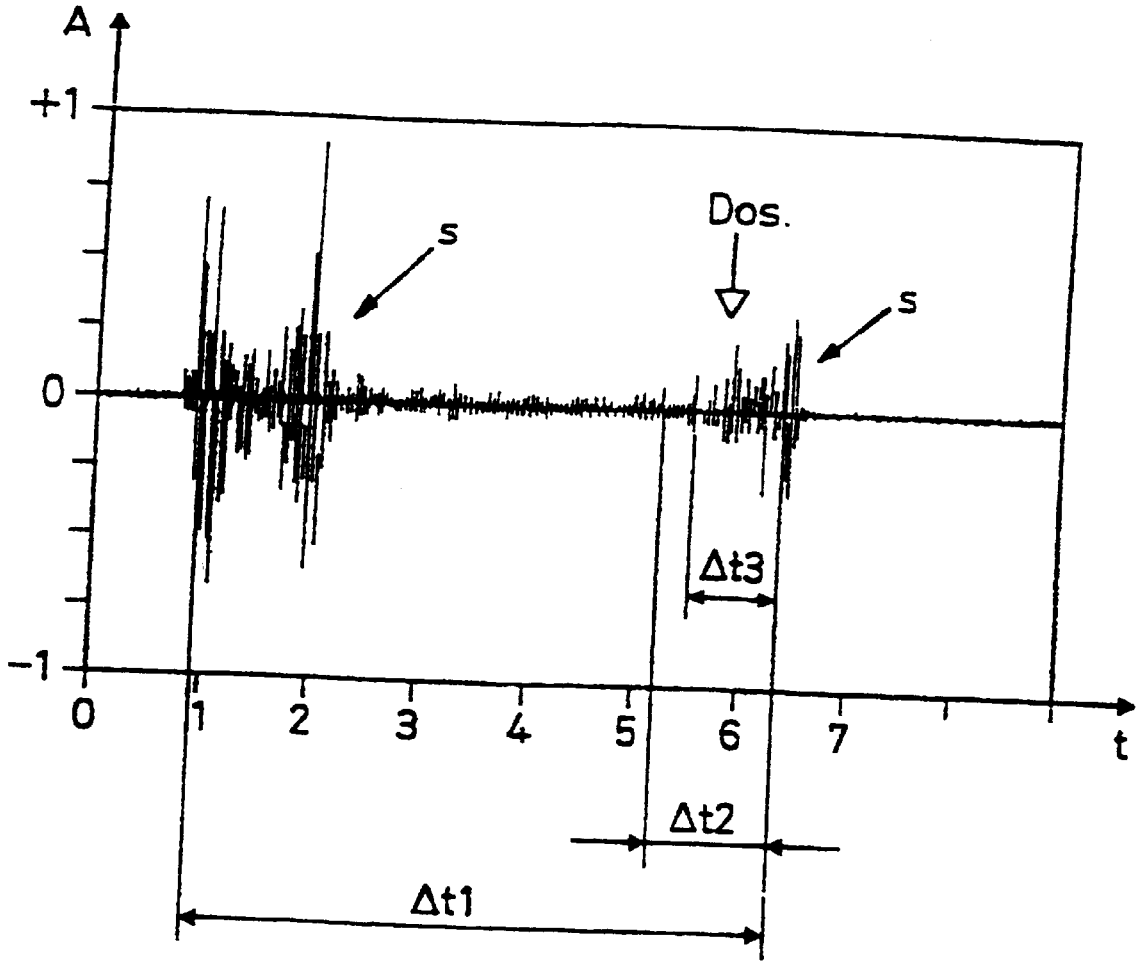

Exemplary embodiments of the invention are described hereinbelow with reference to the annexed drawings, in which:

FIGS. 1*a–c* illustrate characteristic ways of using the subject matter of the invention in urinals;

FIGS. 2*a–c* illustrate ways of using the invention in toilets;

FIG. 3 shows the apparatus of the invention which implements the method of introducing a cleaning and/or deodorizing liquid of the invention;

FIG. 4 is a detail view of an ejector to be utilized in the invention for introducing a cleaning and/or deodorizing liquid, installed in a mixing section; and FIG. 5 shows a typical signal profile during a flushing operation, measured over a column of liquid.

DETAILED DESCRIPTION OF THE INVENTION

The three illustrations of FIG. 1*a–c* each show a well-known urinal 60 which is fastened on a wall W and provided with a supply means 1 for flushing water and a metering unit 100 with a storage container 2 for a suitable liquid agent in accordance with the present invention.

FIG. 1*a* shows how the liquid may be added to the supply means 1 downstream of a flushing cistern 50 by a branch line 5; the second illustration, FIG. 1*b*, has a conventional, automatic flushing valve 80 instead of the flushing cistern. According to the third drawing, FIG. 1*c*, the liquid agent is directed into the supply means 1 via the flushing cistern, while the flushing operation is initiated manually via a flushing button 90.

FIGS. 2*a–c* analogously depict, in conjunction with a likewise conventional toilet bowl 70, alternative configurations of the present invention. Once again, the branch lines 5 serve for directing the liquid into the flushing water.

FIGS. 1*a–c* and 2*a–c* show, by way of example, how the subject matter of the invention can be used universally. An apparatus which can likewise be used universally for implementing the invention is presented in FIG. 3.

As shown therein, the storage container 2, which is closed off by a stub 2*a* and is filled with a suitable liquid 3 containing the desired active agents up to the level N1, is connected to the atmosphere via an air duct 2'. Mounted in the closure stub 2*a* is a suction line 4*a* which extends into the liquid 3 beneath said stub and to which there is connected a connecting hose 10, which terminates at a connection nipple 44 on top flange 42 of a pump 40 with electric motor 41 attached. Pressure hose 46 is plugged into the pump body 43 at a further connection nipple 45, and leads to an intermediate container 20, which forms the housing for a pressure-monitoring means.

This intermediate container 20 is filled with the liquid 3 up to a level N2; located above the liquid is an air cushion 9 which is closed off by a silicone diaphragm 7, having a substrate 8 (thin laminate) made of epoxy resin, on which a pressure sensor 6, a commercially available piezo element (disk of 20 mm diameter printed with piezo silver), is adhesively bonded. Two electric lines 22 are routed out through a top cover 21 and, in response to pressure fluctuations in the air cushion 9, transmit pressure signals s as a result of charge transfers in the sensor 6 to an electronic control unit 30.

The bottom part of the intermediate container 20, is constructed as a connecting branch, and is connected, via a pressure line 4*b*, to a rudimentary ejector 16 which projects into the supply means 1 for the flushing water.

Via the ejector 16, it is possible for the pressure p in the supply means 1 to be monitored by the pressure sensor 6 and evaluated and for the results to be utilized for the optimized addition of the liquid 3 for the next flushing operation. This takes place as follows:

Following installation of the metering unit 100 above the supply means 1, the pump 40 is switched on via a control line ST until the liquid 3 passes out of the ejector 16 at a pressure p. The air cushion 9 forms in the intermediate container 20 in the process, with the result that fluctuations in the pressure P in the supply means 1 are detected by the sensor 6, via the column of liquid in the pressure line 4*b*, and can be registered as a signal s in the electronic control unit 30, which is supplied with power by way of a battery 31. The signal s is amplified and compared in an analog comparator C with an internal reference signal in a manner known per se, evaluated by microprocessor $\mu$P, with the signal profile being standardized over time and stored in order to provide, for the next flushing operation, a control signal ST which is necessary for controlling the pump 40.

It would be possible, in principle, to identify the end of the flushing operation directly by a control signal ST by way of the drop in pressure at the air cushion 9.

With reference to FIG. 5, by measuring the overall signal profile s, taken as pressure amplitude A as a function of the flush time t in seconds, establishing the flushing time $\Delta 1$, and measuring the last time interval $\Delta t2$ during which the pressure P dissipates to a significant extent, it is possible to calculate, and/or set experimentally, the ideal point in time for the metering operation Dos. for the next flushing operation. In practical usage, it has been found that the interval $\Delta t3$ typically commences approximately 1 second before the end of the flushing operation. The point in time of the metering operation Dos. may be further optimized by reference to the drop in pressure (or gradient) in the previously determined time interval $\Delta t2$ It is, of course, possible, by virtue of the above-described learning function, to allow and compensate, within wide limits, for fluctuations in the flushing operation and in the pressure P of the supply means 1.

While FIG. 3 shows the simplest configuration of an ejector 16 in conjunction with a pump 40, FIG. 4 illustrates further developments which make it possible to use a weaker pump or to replace the pump altogether by a straightforward shut-off value 18.

As seen in FIG. 4, the ejector 16' is installed centrally in a mixing section 13 which, by means of threaded sleeves 14, is mounted between the supply means 1 for the flushing water and a supply means 15 in the installation, such as urinal 60 or toilet 70.

In order to take into account the local conditions of the pressure P, the nozzle head is designed in the form of an exchangeable nozzle 17, i.e., depending on the, pressure level, it is possible to install a particular nozzle 17 with a nozzle bore adapted to the actual pressure.

The shape of the head of the nozzle 17 is designed in a manner known per se such that a negative (lower) pressure −p relative to the pressure P of the flushing water is established at the nozzle bore, with result that the liquid 3—even without a pump—is drawn in and mixed with the flushing water.

In cases where the drop in pressure which can be achieved at the nozzle 17 results in an insufficient suction action, a venturi insert 11 may be provided, either formed as a fixed part of the mixing section 13 or as an insert that can be pushed into the mixing section.

The pressure line 4*b* is screwed into the mixing section 13 in a pressure-tight manner by sealing nipples 4; the shutoff value 18 is provided, in a well-known manner, with a solenoid 19 and is likewise activated by the control signal ST, or the corresponding valve tappet, in order to allow throughflow of the liquid 3.

It has been found that it is sufficient to add active-ingredient containing liquid according to the invention in metered amounts of from 0.1 to 0.2 ml for a urinal and in metered amounts of 0.1 to 0.3 ml for a water closet. In order to insure toilet-usage-dependent dilution and a uniform cleaning and protective action of the active ingredient, along with minimal consumption, it is recommended to vary the pumping capacity and/or the quantity of the active ingredient pumped. This can take place, for example, in the case of flushing cisterns with an "economy button", by a microswitch which switches over the rotational speed of the pump motor, or preferably by the evaluation by the control unit of the flushing time for the purpose of determining the appropriate running time for the pump. When the interval between flushes is variable, the liquid may be added during chosen flushing operations when the flushing water flows into the sanitary installation repeatedly at short time intervals, and the liquid may be added during each flushing operation when the flushing water flows into the sanitary installation at longer time intervals.

The present invention makes it possible to limit the consumption of active ingredient to an absolute minimum, with the result that, even in the case of a multiplicity of installed units with frequently used toilets, there are no additional harmful effects to the central sewage clarification or processing plant.

The subject matter of the invention, illustrated here as a separate unit, can easily be integrated in refurbished sanitary installations, with the result that there is a reduction in the risk of damage caused by vandalism etc., in particular in public restrooms.

We claim:

1. A method of introducing a cleaning, disinfecting and/or deodorizing liquid into a sanitary facility, comprising the steps of:

monitoring the pressure of a flushing water in a flush cycle of the sanitary facility to determine a time duration of the flushing cycle and obtain a pressure profile for the flushing cycle;

determining a desired time and duration for the introduction of the liquid into the flushing water during the flushing cycle based on the time duration and the pressure profile of the flushing cycle; and determining the start of a subsequent flush cycle and adding the liquid to the flushing water of the subsequent flush cycle at the desired time for the desired duration.

2. The method of claim 1 wherein the start of a subsequent flush cycle is determined by monitoring the pressure of the flushing water.

3. The method of claim 2 wherein the liquid is added to the flushing water in a mixing section upstream of the sanitary facility.

4. The method as claimed in claim 2, wherein the liquid is added to the flushing water at a positive pressure with respect to the pressure of the flushing water.

5. The method of claim 1 wherein the desired time is chosen such that a minimal quantity of the liquid is added in a final time interval such that those regions of the sanitary facility which are to be kept clean are wetted as completely as possible with a mixture of the flushing water and liquid with the lowest possible level of liquid dilution.

6. The method as claimed in claim 1, wherein the liquid is added to the flushing water by suction generated by the flushing water.

7. An apparatus for implementing the method of claim 1, comprising a container for storing the liquid, a branch line from the container to a flushing water supply line for the sanitary facility; means associated with the branch line for detecting and monitoring the pressure of a flushing cycle; and means coupled to the detecting and monitoring means for determining the desired time and duration for the introduction of the liquid in flushing water during the flushing cycle based on the pressure profile, determining the start of a subsequent flush cycle and adding the liquid to the flushing water of the subsequent flush cycle at the desired time for the desired duration.

8. The apparatus of claim 7, wherein the electronic control unit comprises means for determining the duration of the flushing cycle, identifying a drop in pressure which occurs in a last time interval during the flushing cycle and for adding the liquid during a subsequent flush cycle during a preselected metering interval.

9. The apparatus of claim 8 wherein the means for adding the liquid comprise a pump connected to the storage container and/or a shut-off valve.

10. The apparatus of claim 8, wherein the means for detecting and monitoring the pressure comprises a pressure sensor contained in an intermediate container for the liquid coupled to the branch line having a diaphragm located above a surface of the liquid in the container level to form a pressure-sensing chamber.

11. The apparatus of claim 10 wherein the branch line terminates in an ejector in the supply line.

12. The apparatus of claim 10 wherein the ejector includes venturi means to draws liquid from the container by suction.

* * * * *